United States Patent [19]

Meier

[11] 4,278,019

[45] Jul. 14, 1981

[54] ALL-POINTS ADDRESSABLE DOT PRINTER

[75] Inventor: Johann H. Meier, Vestal, N.Y.

[73] Assignee: International Business Machines Corporation, Armonk, N.Y.

[21] Appl. No.: 58,050

[22] Filed: Jul. 16, 1979

[51] Int. Cl.[3] ..... B41J 3/08; B41J 3/12

[52] U.S. Cl. ..... 101/93.04; 101/93.09; 400/121; 346/101

[58] Field of Search ..... 101/93.04, 93.05, 93.09; 400/121, 124, 125, 125.1; 346/101; 178/30

[56] References Cited

U.S. PATENT DOCUMENTS

| | | | |
|---|---|---|---|
| 2,205,450 | 6/1940 | Wise | 178/11 |
| 2,505,779 | 5/1950 | Long | 346/101 |
| 2,678,255 | 5/1954 | Beam | 346/101 |
| 3,138,429 | 6/1964 | Cooley | 346/101 |
| 3,409,904 | 11/1968 | Maiershofer | 346/101 |
| 3,782,278 | 1/1974 | Barnett et al. | 101/93.04 |
| 3,810,195 | 5/1974 | Kilroy | 346/101 |
| 3,812,495 | 5/1974 | Venker | 101/93.04 X |
| 3,830,975 | 8/1974 | Potter | 178/30 |
| 3,843,955 | 10/1974 | Pear | 346/101 X |
| 3,941,051 | 3/1976 | Barrus et al. | 101/93.04 |

*Primary Examiner*—Paul T. Sewell

*Attorney, Agent, or Firm*—John S. Gasper

[57] ABSTRACT

An all-points addressable dot printer has rows of sloped parallel anvils on a rotating drum. Alternate rows slope in opposite directions for bi-directional printing with a single row of hammer blades. The blades which are spaced apart, are shifted bi-directionally in synchronism with the scanning motion of the anvils to print dots at all dot line points. A second embodiment has a reciprocating comb bar located between the blades and a print medium. Spring fingers on the comb bar have dot forming protrusions. The spring fingers are uniformly spaced with center spacing equal to the center distances between the blades. Comb bar motion is linear with time along the line segments. Blade motion is simple harmonic.

15 Claims, 9 Drawing Figures

FIG. 3
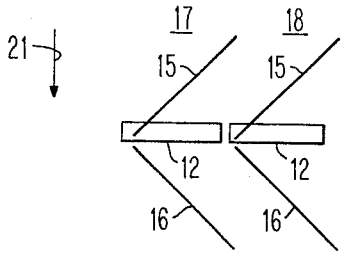
FIG. 5
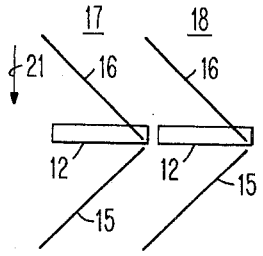
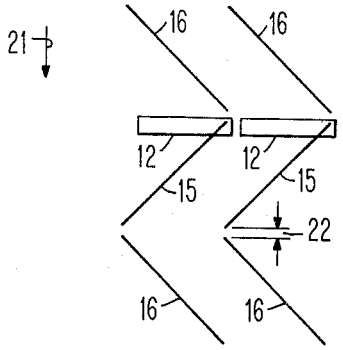
FIG. 4
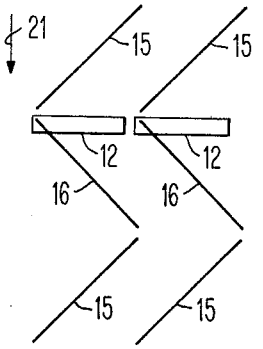
FIG. 6
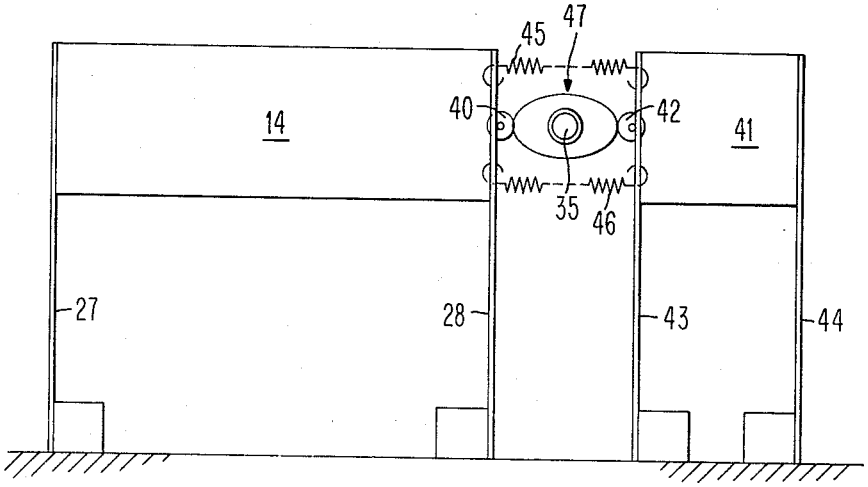
FIG. 7

ALL-POINTS ADDRESSABLE DOT PRINTER

BACKGROUND OF THE INVENTION

1. Field of the Invention

This invention relates to impact printing and in particular to impact printers in which dots are recorded on a print medium to form images, lines, symbols or the like.

2. Discussion of the Prior Art

In an all-points addressable dot printer individual dots are recorded selectively at all addressable point positions in a continuous line of dots extending across a record medium. In order to produce recorded images of good print quality, the recorded dots must be precisely located and uniformly spaced at all addressable points of the line and it is desirable to be able to record successions of spaced dots as closely together as possible.

U.S. Pat. No. 2,205,450 issued to R. J. Wise, uses a single helical anvil on the rotating drum in combination with a single marking blade or print bar which extends entirely across the line of print. While capable of recording closely spaced dots with uniform spacing, this type of printer is speed limited. This is particularly true where the print lines are guite long.

U.S. Pat. No. 3,138,429, issued to A. G. Cooley, provides a mechanism for printing at somewhat higher speeds by providing an anvil with a plurality of convolutions. A single marking blade is transversely flexible and can record dots simultaneously at several spaced intervals across the line. The transversely flexed marking blade and its operating mechanisms are complex structures. Additionally, the convolutions of the anvil must be relatively widely separated to avoid shadow printing from adjacent sections of a single flexible bar when making contact with the anvil.

Much higher recording speeds have been achieved by using plural separate and individually operable marking blades aligned in a single row. A helical anvil on a rotating cylinder has a large number of convolutions. Each convolution is spanned by a single hammer. Examples of such printers are shown in U.S. Pat. Nos. 3,409,904, issued to K. Maiershoffer; 3,810,195, issued to H. P. Kilroy, et al; 3,813,492, and 3,830,975, both issued to J. T. Potter; 3,843,955, issued to C. B. Pear, Jr.

In the multiple blade and helix printers of the type disclosed in the above-mentioned references, a separation or gap exists between the blades to permit interference-free individual operation. The blade separation presents no problem for character printing since such printing naturally requires some separation between characters for legibility. However, in all-points addressable printing, the blade separation that must exist between the individual blades is a limiting factor on the density of the dots. Non-uniformity of the blade separation contributes to degraded print quality. Minimizing the dimension of blade separation and maintaining its uniformity between all print hammer blades requires costly structures and great care in assembly.

All-points addressable printers having also been provided using other structures. In U.S. Pat. No. 3,941,051, issued to Barrus, et al, uniformly spaced dot printing hammers on a common carrier are reciprocated along the print line the full length of a print segment. The amplitude of motion of the hammers is relatively large, thereby requiring large dynamic forces.

SUMMARY OF THE INVENTION

It is a general object of this invention to provide an improved dot printer.

It is a more specific object of this invention to provide an improved all-points addressable dot printer.

It is a further specific object of this invention to provide an improved dot printer capable of recording dots in locations corresponding to the space representing the separation between individual print blades in a print line.

It is a still further object of this invention to provide an all-points addressable anvil and blade type printer which is operable at high speeds with improved print quality and high dot densities and which is economical to build and operate.

The above, as well as other objects, may be attained in accordance with this invention by providing in a first embodiment a plurality of sloping bar anvils which are arranged mutually parallel in a row extending parallel with the print line. Each anvil has a longitudinal span corresponding to a plural dot line segment of a continuous multi-segment longitudinal print line. The anvils are moved transverse to the print line causing each to scan one of the contiguous ine segments. Cooperable with the sloping anvils are a plurality of print hammer blades arranged in a single longitudinal line parallel with the print line. The blades are spaced apart, each blade having a width less than the longitudinal span of corresponding ones of the sloping anvils and the corresponding print line segment. Thus the contiguous line segments are of equal length with center distances being equal to the center distances between blades.

The plural hammer blades are longitudinally shifted in synchronism with relative motion of the anvils by an amount which equals the difference between the span of the anvils and the width of the hammer blades. In this way the print line of dots can be recorded at every addressable point in the print line. Because of the relatively large separation between the print blades, interference during operation is eliminated.

In the preferred form of the first embodiment of this invention the anvils are formed on the surface of a rotatable drum. The plurality of sloping anvils is arranged in rows. Alternate rows are sloped in opposite directions. The hammer blades are shifted longitudinally in both directions in accordance with the direction of scan of the alternately sloping anvils. Because of the separation in hammers, the number of hammers and the number of anvils can be increased so that a larger number of hammers can be operated in parallel at a larger number of distributed points of the print line.

In a second embodiment the scanning means comprises flexible fingers uniformly spaced along the print line with a center spacing equal to the center distances between the blades and the print line segments. The flexible fingers, which may be part of a comb structure, are reciprocated in the direction of the print line with an amplitude at least equal to the center distance between contiguous print line segments. The hammer blades are spaced apart and have a width which is less than the length of a print line segment. The hammer blades are oscillated along the print line in synchronism with the fingers, the amplitude of oscillation being at least equal to the gaps between the blades.

Thus, in accordance with the invention, high density dot printing is readily obtained. Blade oscillation occurs over a very small distance. This keeps dynamic forces at a minimum since large accelerations of relatively large masses are avoided.

The foregoing and other objects, features and advantages of the invention will be apparent from the following more particular description of a preferred embodiment of the invention, as illustrated in the accompanying drawing.

DESCRIPTION OF THE DRAWINGS

FIGS. 3–6 are a sequence of schematic planar developments showing the spatial relationships of the anvil and blades of the mechanism of FIGS. 1 and 2.

FIG. 7 shows a second embodiment of the blade support and shift mechanism useful in practicing the invention.

DETAILED DESCRIPTION

Figure 1:
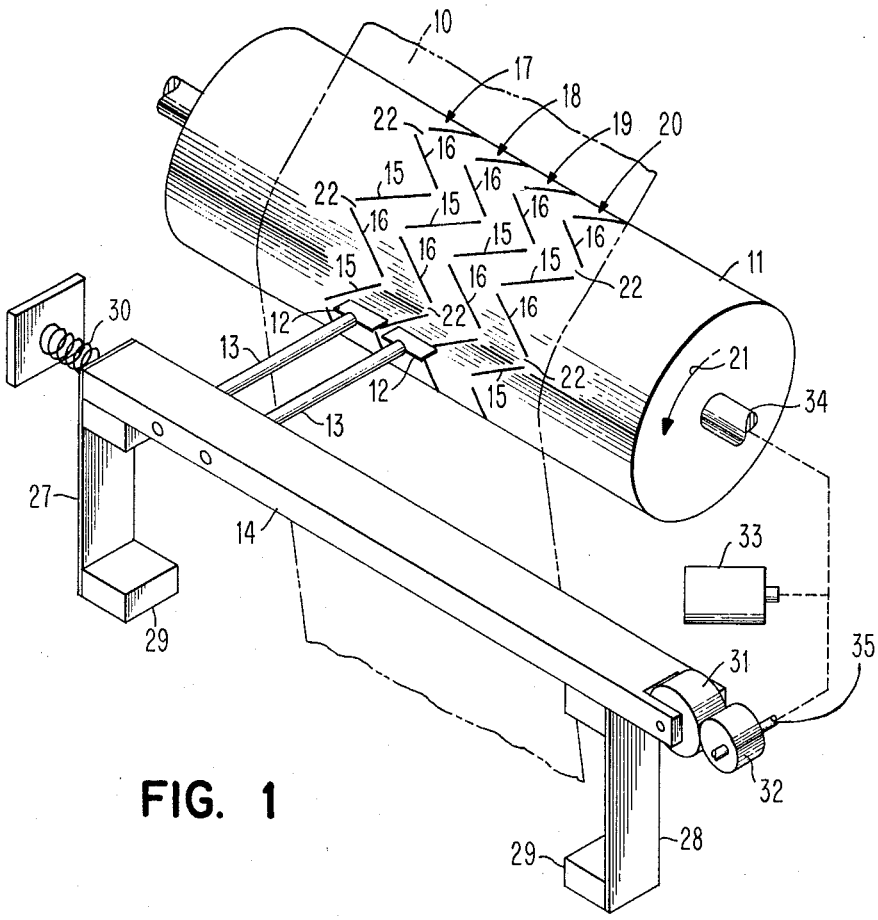
FIG. 1 is a three-dimensional drawing of a dot printer mechanism incorporating the present invention.
Figure 2:
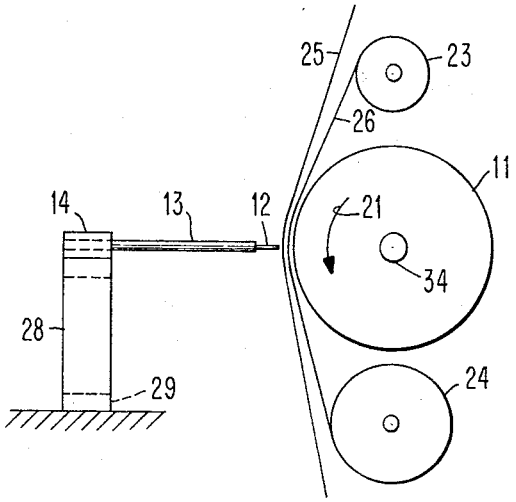
FIG. 2 shows a side view of the print mechanism of FIG. 1.

As seen in FIGS. 1 and 2 record medium 10 such as an ink ribbon 25 and paper web 26 extending between rolls 23 and 24 (see FIG. 2) is fed between a rotating print cylinder 11 and a horizontal row of hammer blades 12. Blades 12 are carried at the end of actuators 13 which extend from and are supported by a horizontal support bar 14. The actuators 13 may take various forms and are essentially illustrated in a schematic fashion. For example, actuators 13 may comprise solenoids which are individually energized and which when energized reciprocate an operating rod or the like to which blades 12 can be attached causing the blades 12 to be moved forward a short distance in a rapid stroke in a direction perpendicular to the tangent plane of the recording medium 10 on drum 11.

As seen in FIG. 1 rotating drum has a plurality of bar anvils 15 and 16 arranged on its surface in a plurality of columns or rings 17, 18, 19 and 20. The number of rings can be selected on the basis of the desired length of the print line and the print speed. In this case four rings are shown to illustrate the invention.

Anvils 15 and 16 are sloped relative to the print line to provide scanning along the line. Because the slopes of anvils 15 and 16 are opposite, i.e. in a zig-zag pattern scanning will occur successively in opposite directions. Thus, as drum 11 rotates in the direction indicated by arrow 21, the row of anvils 15 in adjacent columns 17–20 simultaneously scan from left to right while the row of anvils 16 scan from right to left. The rows of anvils are separated by a timing gap 22. This allows a time interval for the advance of paper web 26 for succeeding dot lines.

The width of the scan by anvils 15 and 16 is a segment of a line covering a plurality of dot positions. In addition, the combined span of the parallel anvils 15 and 16 in a row covers every possible dot position in the line. In other words, there are no dot position gaps in the scan provided by the rows of anvils 15 and 16. To achieve this, the length of adjacent anvils is such that the horizontal projection of their adjacent ends overlap slightly or touch. For example, as seen most clearly in FIG. 3, the projection of the right end of anvil 15 in column 17 touches the left end of anvil 15 in column 18, and so on. The same applies to the anvils 16.

As previously discussed, the width of blades 12 is less than the longitudinal span of the anvils 15 and 16. The gaps between the blades 12 can be appreciable which allows them to be operated with little prospect of mechanical interference. The net difference between anvil span and blade width is appreciable. It can be one or more dot positions, depending on the anvil and blade thickness dimensions as well as the size of the gap. In accordance with this invention the blades 12 are shifted as a group in synchronism with the scanning operation of the anvils. For this purpose support bar 14 (see FIGS. 1 and 2) is mounted on the ends of flexure members 27 and 28 which are fixed to a base 29. Coil spring 30 applies a constant bias force to the end of support bar 14 so that cam roller 31 on the opposite end of support bar 14 is held in continuous contact with cam 32. Drive 33, which may be a motor and gear unit for example, has a common drive connection to shaft 34 of the print cylinder 11 and cam shaft 35 such that cam 32 reciprocates support bar 14 in left and right directions along the print line causing blades 12 to be shifted right and left in coordination with the direction of scanning by anvils 15 and 16. In this way blades 12 line up with every dot position in the print line scanned by the anvils 15 and 16.

The details of operation for columns 17 and 18 are illustrated in the sequential drawings shown in FIGS. 3–6. In FIG. 3 blades 12 have been displaced by cam 32 to the left against the bias force applied by coil spring 30 to support 14. In this position, blades 12 overlap the left edges of anvils 15. As anvils 15 move in the direction indicated by arrow 21, blades 12 shift slowly to the right to a more or less central position where the anvils may be impacted for all points of intersection with blades 12 between the extremities of the anvils. In FIG. 4 blades 12 have been shifted to the extreme right position as a result of cam 32 having been rotated to its lowest point and the bias force of coil 30 bending flexure members 27 and 28. Thus, one dot line of printing will have been completed and the cycle of operation for a second dot line will follow. In the interval during which gap 22 moves past blades 12, paper 26 can be advanced a line increment in readiness for the printing of the next dot line.

FIGS. 5 and 6 show the sequence of printing from right to left. In FIG. 5 blades 12 are in the extreme right position which corresponds to the position shown in FIG. 4. In this position blades 12 extend beyond the right extremity of the bottom of anvils 16. Cam 32 at that time is still at its lowest point and flexure members 27 and 28 have been bent to the right under the superior force of coil spring 30. As anvils 16 move downward in the direction indicated by arrow 21, cam 32 is rotated from its lowest point to an intermediate point moving blades 12 to the center position in opposition to the bias force of coil spring 30. In this position blades 12 are able to strike all but the extreme left and right dot positions scanned by anvils 16. FIG. 6 shows the location of blades 12 which covers the left extremities of anvils 16 for forming dots at the end of the right to left scan very close or even superimposed on the dots formed in adjacent columns at the beginning of the scan. In this position cam 32 is at its high point, flexure members 27 and 28 have been bent to the left and blades 12 are in position to repeat the left to right scan after the paper motion interval allowed by gap 22 for the succeeding dot line. Thus dots are formed very closely together. Blades 12 can be operated without fear of interference. The gaps between blades 12 need not be highly precise since a certain amount of shift overlap is provided as previously shown.

In FIG. 7 a blade shift mechanism which dithers the blades 12 and associated actuators in a sinesoidal motion pattern is shown. Support bar 14 on flexure members 27 and 28 has a cam roller 40 on its right side. The dynamic counterweight 41 with a cam roller 42 is supported on a second pair of flexure members 43 and 44. Tension springs 45 and 46 attached to support bar 14 and counterweight 41 maintain rollers 40 and 42 in continuous contact with a cam 47 rotatably supported on shaft 35. Cam 47 is contoured to provide a simple harmonic motion.

The shift mechanism of FIG. 7 displaces hammer blades 12 with essentially a simple harmonic motion which can be sinesoidal which minimizes accelerations of the hammer blades.

The print mechanism described may be operated at relatively high speeds for coarse printing and can be slowed down for denser printing. In addition, the character pitch and line pitch are conveniently selectable. Furthermore, the mechanism provides a simple and reasonable cost solution to the vexing problem of good print quality free from shadow printing at all addressable points of a dot matrix.

Figure 8:
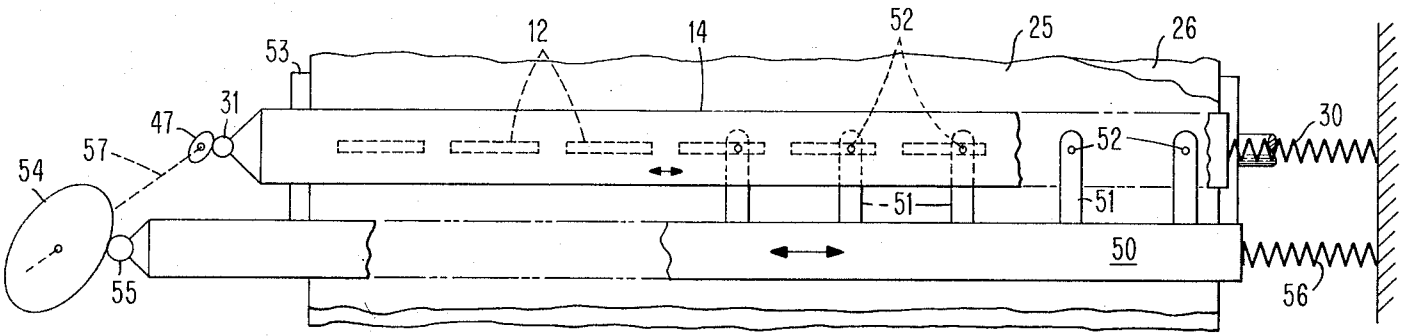
FIG. 8 shows a second embodiment of the invention.
Figure 9:
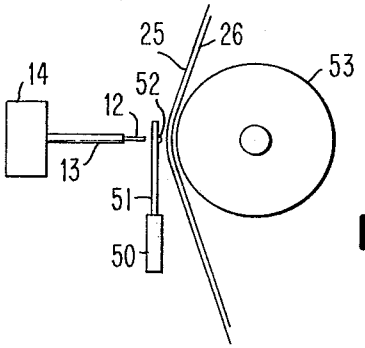
FIG. 9 is a side view of part of the print mechanism of FIG. 8.

In FIG. 8, the scanning mechanism comprises a comb bar 50 supporting plural flexible print fingers 51, each having a dot forming protrusion 52. The print fingers 51 are uniformly spaced along the comb bar 50 a distance equal to the desired length of the print line segments. Print fingers 51 are positioned in alignment with hammer blades 12 whereby print fingers 51 are struck to impact ink ribbon 25 and paper 26 against a rotatable platen 53. A shift mechanism for comb bar 50 comprises cam 54 and roller 55 attached to the end of comb bar 50. Coil spring 56 applies a bias force to comb bar 50 for maintaining continuous contact between cam 54 and roller 55. The supporting structure for comb bar 50 may consist of flexure members of the type illustrated in FIG. 7. The shift mechanism for the support bar 14 and hammer blades 12 is the same as previously described. The amplitude of reciprocation caused by cam 54 needs to cover at least the length of a print line segment whereas the amplitude of oscillation of support bar 14 caused by cam 47 needs to cover only the gap between hammer blades 12. Preferably the motion of the comb bar 50 while traversing the print line segments is linear with time and the motion of the support bar 14 is simple harmonic. The cams 54 and 47 would be contoured accordingly. Additionally the cams 54 and 47 can be rotated by a common shaft 57 to provide the desired synchronism of the two motions and the cams 54 and 47 are phased so that the motion of support bar 14 and comb bar 50 occur in the same direction.

While the invention has been particularly shown and described with reference to preferred embodiments thereof, it will be understood by those skilled in the art that the foregoing and other changes in form and details may be made therein without departing from the spirit and scope of the invention.

Having thus described my invention, what I claim as new, and desire to secure by Letters Patent is:

1. An all-points addressable dot printer apparatus comprising in combination, a plurality of sloping bar anvils adapted to be individually impacted by a plurality of longitudinal hammer blades, said plural sloping anvils being arranged mutually parallel in a row extending parallel with a print line, and each anvil having a longitudinal span corresponding to a plural dot line segment of a continuous multi-segment longitudinal print line, said sloping anvils in combination spanning all dot positions of said continuous multi-segment print line, said plural blades being longitudinally aligned parallel with said print line, said blades being spaced apart and each having a width less than said longitudinal span of corresponding ones of said sloping anvils, means for effecting relative motion of said anvils and said blades whereby said anvils in combination scan every dot position of said print line, and means for shifting said plural hammer blades longitudinally in synchronism with said anvils by at least the differential amount between said span of said anvils and said width of said hammer blades whereby said anvils are impactable by said blades at every addressable dot position of said print line.

2. An all-points addressable dot printer in accordance with claim 1 in which said means for effecting said relative motion comprises a carrier for said anvils, said sloping anvils being arranged on said carrier to form contiguous columns vertically disposed relative to corresponding longitudinal hammer blades spaced to be aligned with said vertical columns.

3. An all-points addressable dot print in accordance with claim 2 in which said carrier is a revolvable drum member and said anvils are arranged in rings on the periphery of said drum member, said relative motion of said anvils and said hammer blades causes said anvils in said rings to repeatedly scan all addressable points on said longitudinal line segments, and said shift means displaces said hammer blades in the direction of scanning by said anvil means.

4. An all-points addressable dot printer in accordance with claim 1 in which said sloping anvils are arranged in plural successive rows and said successive rows of anvils slope alternately in opposite directions whereby said anvils alternately scan in opposite longitudinal directions, and said shifting means move said hammer blades bidirectionally along said print line in longitudinally opposite directions.

5. An all-points addressable dot printer in accordance with claim 4 in which said means for effecting said relative motion comprises a movable carrier for said anvils, said sloping anvils being arranged on said carrier to form contiguous columns, and said alternately sloping anvils in said columns form a zig-zag anvil pattern relative to said hammer blades.

6. An all-points addressable dot printer in accordance with claim 5 in which said carrier for said anvils is a rotatable drum, and said zig-zag anvil patterns are arranged in contiguous rings arround the periphery of said rotatable drum, said rings individually having an even number of said anvils.

7. An all-points addressable dot printer in accordance with claim 1 in which said amount of shifting of said blades by said shifting means is slightly greater than the difference between the width of the line segment scanned by said anvils and the width of said blades.

8. An all-points addressable dot printer in accordance with claim 7 in which said anvils have a width and are arranged so as to slightly overlap adjacent line segments scanned by adjacent anvils.

9. An all-points addressable dot printer in accordance with claim 1 in which said shift means comprises a support bar for said hammer blade said support bar maintaining said blades in uniformly-spaced horizontal alignment, flexure means suppporting said support bar in horizontal position, and Oscillating means for shifting said support bar horizontally along said print line by at least said differential amount in synchronism with said scan motion of said anvils.

10. An all-points addressable dot printer in accordance with claim 9 in which said oscillating means includes camming means operable cyclically for displacing said support bar in opposite horizontal directions, and spring means applying bias force to said support bar in opposition to said camming means.

11. An all-points addressable dot printer in accordance with claim 10 in which said camming means oscillates said support bar with a simple harmonic motion.

12. An all-points addressable dot printer apparatus comprising in combination, a recording medium;

means to advance said recording medium by one vertical dot spacing at a time;

a plurality of equal-length hammer blades being longitudinally aligned with a horizontal print line, said print line comprising contiguous multiple dot print line segments of equal length along said print line with the center-distance of said segments being equal to the center-distance between said blades;

said blades being spaced apart by a gap of one or more dots and each having a multiple dot length along said print line less than the center-distance between said blades;

scanning means coacting with said blades for recording dots on said recording medium at all dot positions of said print line, said scanning means comprising plural scanning elements operable along the length of said print line segments so that subsequent strikes of said blades cause adjacent dots to be printed;

said scanning means alternating between left to right and right to left along said segments; and means for oscillating said blades in synchronism with said scanning means in the direction of said print line, the total amplitude of oscillation of said blades being at least equal to said gap between said blades.

13. An all-points addressable dot printer according to claim 12 in which said scanning means is provided by a plurality of helical bar anvils disposed on the surface of a rotating print drum, said print drum being located on the opposite side of said recording medium from said hammer blades, said bar anvils being arranged in cylindrical rings on said print drum, with the slope of the helix alternating between circumferentially adjacent bar anvils;

said cylindrical rings being identical and identically arranged along the length of said print drum;

the projections of said bar anvils on said print line being at least equal to the length of said print line segments, and the center of said projections of said bar anvils on said print line coinciding with the center of said segments.

14. An all-points addressable dot printer according to claim 12 in which said scanning means is provided by reciprocating motion of print fingers along said print line, said print fingers being located between said print medium and said hammer blades, said reciprocating motion being synchronized and of equal amplitude for all print fingers, said amplitude being at least equal to the length of said print line segments, and the center position of said reciprocating motion coinciding with the center of said segments.

15. An all-points addressable dot printer in accordance with claim 14 in which said reciprocation motion of said print fingers is linear with time, and said oscillation of said blades is simple harmonic.

* * * * *